US008746121B2

(12) United States Patent
Hubsch

(10) Patent No.: US 8,746,121 B2
(45) Date of Patent: Jun. 10, 2014

(54) BALLISTIC PROTECTION GRID HAVING AN ACCESS HATCH

(75) Inventor: Alain Hubsch, Roanne (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 13/430,232

(22) Filed: Mar. 26, 2012

(65) Prior Publication Data

US 2012/0255431 A1 Oct. 11, 2012

(30) Foreign Application Priority Data

Apr. 7, 2011 (FR) ..... 11 01095

(51) Int. Cl.
*F41H 5/06* (2006.01)

(52) U.S. Cl.
CPC ..... *F41H 5/06* (2013.01)
USPC ..... 89/36.01; 89/918

(58) Field of Classification Search
USPC ..... 89/36.01, 36.02, 36.04, 36.12, 36.14, 89/36.15, 901, 920, 929, 930, 931, 936, 89/36.08
See application file for complete search history.

(56) References Cited

U.S. PATENT DOCUMENTS

| | | | | |
|---|---|---|---|---|
| 1,385,897 | A * | 7/1921 | Tresidder | 114/9 |
| 2,601,197 | A * | 6/1952 | Wilson | 220/485 |
| 2,663,271 | A * | 12/1953 | Becker | 109/31 |
| 3,765,301 | A * | 10/1973 | Pagano et al. | 89/36.08 |
| 5,354,036 | A * | 10/1994 | Brown | 256/25 |
| 7,882,776 | B2 * | 2/2011 | Medwell et al. | 89/36.02 |
| 8,042,449 | B2 * | 10/2011 | Farinella et al. | 89/36.01 |
| 2008/0257141 | A1 * | 10/2008 | Medwell et al. | 89/36.02 |
| 2011/0113952 | A1 * | 5/2011 | Rosenwasser et al. | 89/36.02 |
| 2011/0232472 | A1 * | 9/2011 | Kellner et al. | 89/36.08 |
| 2012/0011993 | A1 * | 1/2012 | Malone et al. | 89/36.02 |
| 2012/0137866 | A1 * | 6/2012 | Gonard et al. | 89/36.08 |
| 2012/0247316 | A1 * | 10/2012 | Farinella et al. | 89/36.02 |
| 2012/0291616 | A1 * | 11/2012 | Andrewartha et al. | 89/36.02 |
| 2013/0025442 | A1 * | 1/2013 | Lee | 89/36.02 |

FOREIGN PATENT DOCUMENTS

| | | | |
|---|---|---|---|
| EP | 1 944 566 | A1 | 7/2008 |
| GB | 2 448 477 | A | 10/2008 |
| WO | WO 2009/064263 | A2 | 5/2009 |

OTHER PUBLICATIONS

Written Opinion issued in French Application No. 1101095 dated Nov. 17, 2011 (with translation).

* cited by examiner

*Primary Examiner* — Reginald Tillman, Jr.
(74) *Attorney, Agent, or Firm* — Oliff PLC

(57) ABSTRACT

The subject-matter of the invention is a ballistic protection grid for a vehicle comprising an access hatch received in an opening of the grid, wherein the grid and the hatch comprise bars separated from each other by an inter-bar distance, the protection grid being characterized in that the access hatch partially conceals the opening of the grid, each edge of the opening of the grid being separated from the sides of the hatch by a distance substantially equal to the inter-bar distance.

7 Claims, 3 Drawing Sheets

BALLISTIC PROTECTION GRID HAVING AN ACCESS HATCH

CROSS REFERENCE TO RELATED APPLICATIONS

Applicant claims priority under 35 U.S.C. 119 of French patent application no. 1101095 filed on Jul. 4, 2011.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The invention belongs to the technical field of ballistic protection grids.

To protect the armored vehicles from the attacks of shaped charge projectiles, rigid protection grids placed at a distance from the walls of the vehicle are used.

These grids comprise bars spaced from each other. The function of the bars is to deteriorate the warhead of the incident projectile, so as to destroy the firing contact of the shaped charge, thus preventing its triggering.

The bars of the grid should not be too spaced apart from each other to prevent the passage of a projectile between them. However, they should be sufficiently spaced apart to reduce as much as possible the probability of having the projectile fuse directly hitting a bar, which would cause the firing of the shaped charge.

For the same reasons of reduction of the probability of contact of a bar with the projectile fuse, the bars also have to expose to the impact of the projectiles a surface as reduced as possible on the face of the grid undergoing the attacks.

On the armored vehicles, the grids constitute an obstacle to the access to the elements disposed at the periphery of the vehicle. Thus, to access a door handle or a tank cap, it is known to form an opening in the grid facing the region to which access is desired and then to place a hatch of a structure identical to the grid to conceal this opening.

However, this access solution through the grid has one drawback.

The opening of the grid comprises a first frame bordering this opening. In correspondence with this frame is disposed a second frame bordering the access hatch which conceals the opening of the grid. At the joint between the opening and the hatch, the juxtaposition of the frames significantly increases the apparent surface exposed to the threat, and the probability of having this junction region impacted by a projectile fuse.

BRIEF SUMMARY OF THE INVENTION

Thus, the subject-matter of the invention is a ballistic protection grid for a vehicle comprising an access hatch received in an opening of the grid, the grid and the hatch comprising bars separated from each other by an inter-bar distance, the ballistic protection grid being characterized in that the access hatch partially conceals the opening of the grid, each edge of the opening of the grid being separated from the sides of the hatch by a distance substantially equal to the inter-bar distance.

According to one feature, the hatch is securable in a closed position to the grid by a locking means.

According to one embodiment, the locking means comprises at least a first tab on one side of the hatch and positioning itself facing a second tab secured to an edge of the grid, a fastening member securing the tabs.

According to another feature, the hatch comprises at least a hinge secured to an edge of the grid by one end and secured to a side of the hatch by its other end.

Advantageously, the edges of the grid and/or the sides of the hatch are delimited by a frame formed by bars.

BRIEF DESCRIPTION OF THE SEVERAL VIEWS OF THE DRAWING

The invention will be better understood from the following description, by reference to the appended drawings in which.

DETAILED DESCRIPTION OF THE INVENTION

Figure 1:
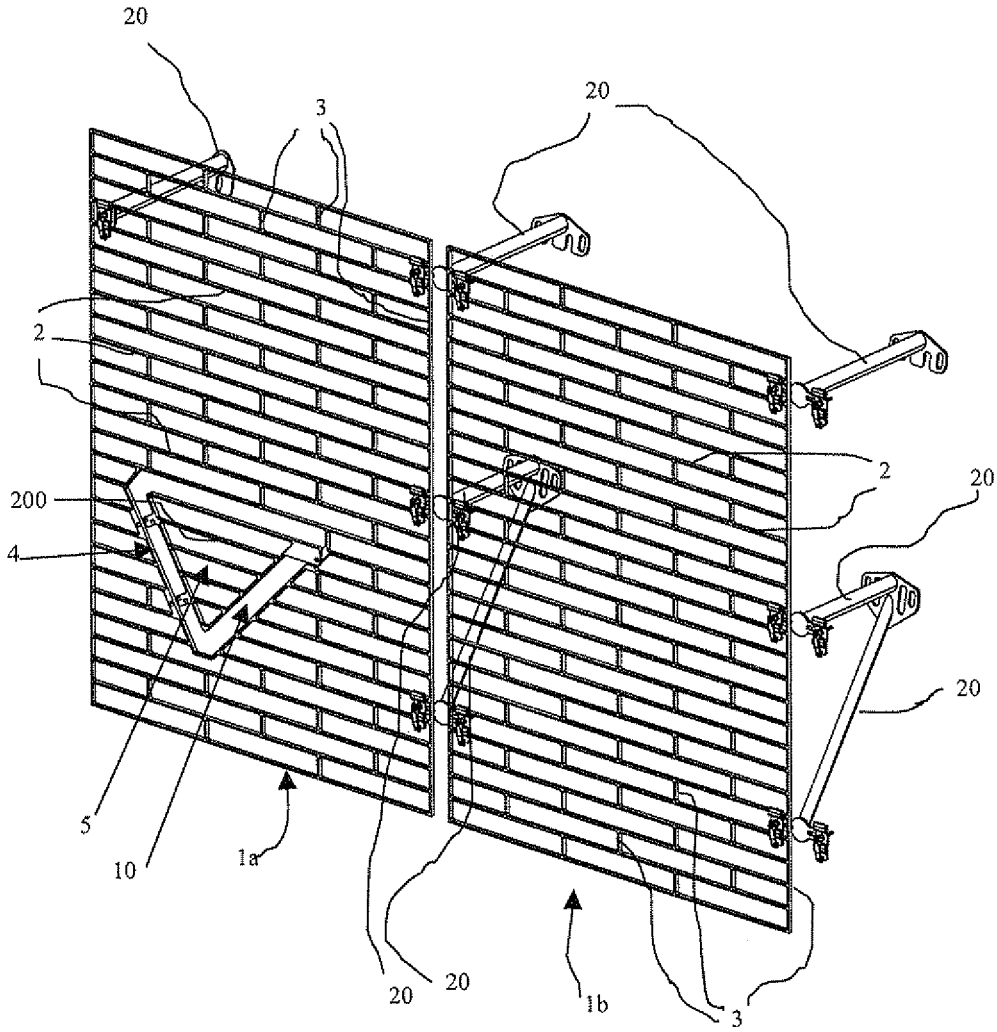
FIG. 1 depicts a three quarter view of two side-by-side protection grids, one of which being according to the invention.

According to FIG. 1, ballistic protection grids 1*a* and 1*b* are placed at a distance from the walls of a vehicle using arms 20 (the walls and the vehicle are not shown). These grids 1*a* and 1*b* comprise bars 2 parallel to each other. These bars 2 are connected to each other by posts 3.

The grid 1*a* according to the invention comprises an opening 4 partially concealed by a hatch 5. The hatch 5 is secured to the grid 1*a* and it comprises bars 200. The hatch 5 and the grid 1*a* are made of the same material, preferably steel of a hardness greater than 360 Brinells, and the bars 2 and 200 have the same dimensional features for the hatch 5 and for the grid 1*a*.

Figure 2:
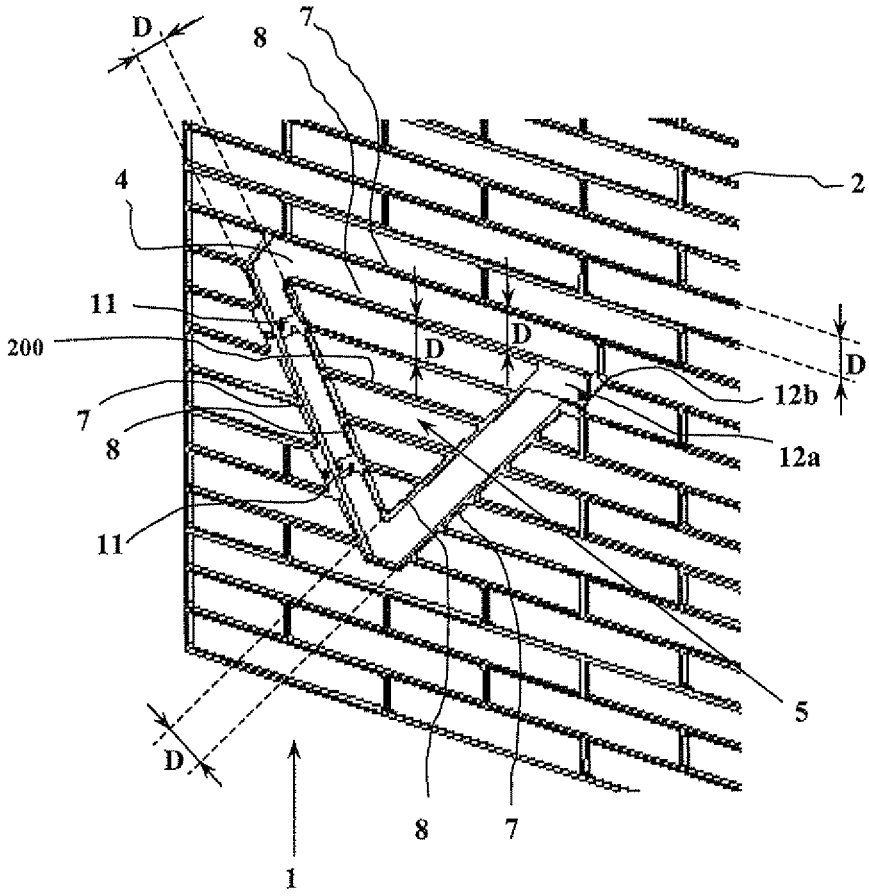
FIG. 2 depicts a detailed view of a part of the protection grid according to the invention.

According to FIG. 2, each bar 2 of the grid is separated from the neighboring bar by a distance D. This inter-bar distance D is sufficiently reduced to prevent a projectile (projectile not shown) from passing between the bars 2 without its warhead coming to hit at least one bar 2. This distance D is also chosen sufficiently large to reduce the probability of having a projectile fuse hitting a bar 2. The distance D is around 50 mm.

The hatch 5 comprises a spacing D of its own bars 200 equal to the distance D separating the consecutive bars 2 of the grid 1*a*.

The opening 4 formed in the grid 1*a* is delimited by edges 7 also disposed at a distance D from the sides 8 of the hatch 5. According to this embodiment, the hatch and its opening are triangular and the three edges 7 of the grid 1*a* and the three sides 8 of the hatch 5 are all materialized by bars which have the same section as the bars 2 and are made of the same material (steel of a hardness greater than 360 Brinells).

Thus, the protection grid 1 provides a more homogeneous protection throughout its whole surface. A rocket trying to penetrate in the region 10 between the sides of the hatch 5 and the edges 7 of the opening 4 has as many chances of having its warhead deteriorated without its fuse hitting any structural element of the grid 1*a* as in any other location of the grid 1*a* or of the hatch 5.

It will be noted that the hatch 5 does not integrally cover the opening 4 of the grid 1*a* and leaves a region 10 of a width D between the edges 7 of the grid 1 and the sides 8 of the hatch 5. The cover reduction of the opening 4 by the hatch 5, besides optimizing the protection, lightens the protection device.

The hatch 5 is secured to the grid 1*a*. To achieve this, two coaxial hinges 11 secured to a same edge 7 of the grid 1*a* are fixed to a side 8 of the hatch 5. In addition, the hatch 5 is securable in the closed position (as shown in FIG. 2) to the grid 1*a* by a locking means which comprises a first tab 12*a* carried by a side of the hatch 5 and which positions itself facing a second tab 12*b* secured to an edge of the grid 1*a*. A fastening member (such as a bolt) allows to secure the tabs 12*a*, 12*b*, and therefore to lock the hatch.

Figure 3:
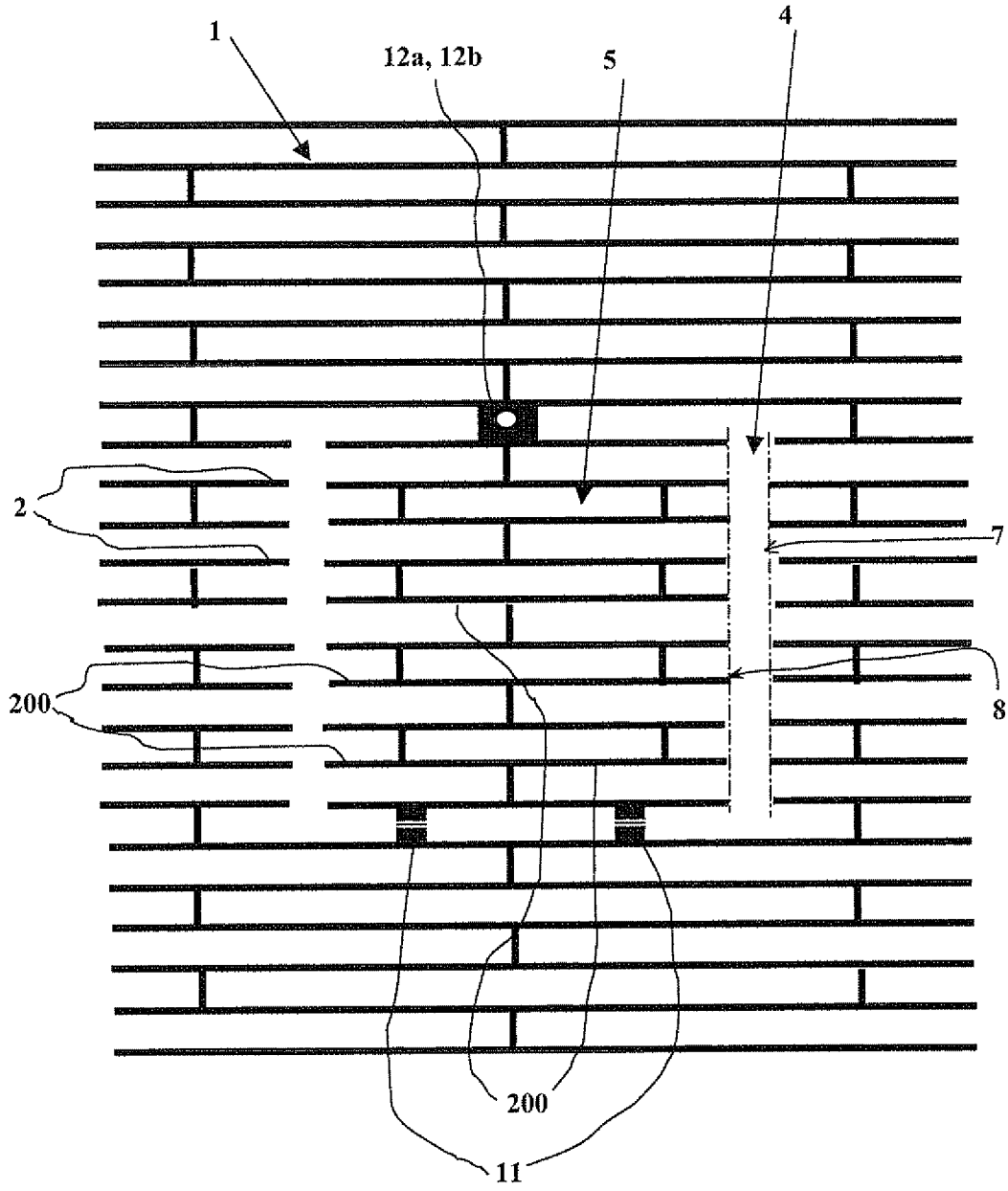
FIG. 3 depicts a front detailed view of a part of a protection grid according to another embodiment.

FIG. 3 shows another embodiment of the invention wherein the opening 4 and the hatch 5 are rectangular. In addition, two of the parallel edges 7 of the opening 4 are not materialized by bars but are defined by the ends of the bars 2 and 200 bordering the opening at these edges.

Also, the two corresponding sides 8 of the hatch 5 are not materialized by bars but are also defined by the ends of the bars of the hatch 5.

According to another embodiment, not shown, it is possible to consider making a hatch 5 of a smaller or greater size, as required. Thus, it is possible for instance to make a hatch 5 with the dimensions of a door for boarding a vehicle.

The invention claimed is:

1. A ballistic protection grid for a vehicle comprising:

arms configured to fix the grid at a distance from walls of the vehicle; and an access hatch received in an opening of the grid, the grid and the hatch comprising bars, consecutive bars being separated from each other by an inter-bar distance, the inter-bar distance being sufficiently reduced to prevent a predetermined projectile having a warhead and a fuse from passing between the bars without the warhead hitting at least one bar, and the inter-bar distance being sufficiently large to reduce the probability of having the fuse of the projectile hitting a bar, wherein the access hatch partially conceals the opening of the grid, each edge of the opening of the grid being separated from the sides of the hatch by a distance substantially equal to the inter-bar distance.

2. The ballistic protection grid according to claim 1, wherein the hatch is securable in the closed position to the grid by a locking means.

3. The ballistic protection grid according to claim 2, wherein the locking means comprises at least a first tab on a side of the hatch and positioning itself facing a second tab secured to an edge of the grid, a fastening member securing the tabs.

4. The ballistic protection grid according to claim 1, wherein the hatch comprises at least a hinge secured to an edge of the grid by one end and secured to a side of the hatch by its other end.

5. The ballistic protection grid according to claim 2, wherein the hatch comprises at least a hinge secured to an edge of the grid by one end and secured to a side of the hatch by its other end.

6. The ballistic protection grid according to claim 3, wherein the hatch comprises at least a hinge secured to an edge of the grid by one end and secured to a side of the hatch by its other end.

7. The ballistic protection grid according to claim 1, wherein the edges of the grid and/or the sides of the hatch are delimited by a frame formed by bars.

* * * * *